US010434668B1

(12) United States Patent
Kollias

(10) Patent No.: US 10,434,668 B1
(45) Date of Patent: Oct. 8, 2019

(54) MULTIFUNCTIONAL CUTTING TOOL

(71) Applicant: Scott Kollias, Northbrook, IL (US)

(72) Inventor: Scott Kollias, Northbrook, IL (US)

( * ) Notice: Subject to any disclaimer, the term of this patent is extended or adjusted under 35 U.S.C. 154(b) by 0 days.

(21) Appl. No.: 15/985,849

(22) Filed: May 22, 2018

Related U.S. Application Data

(63) Continuation-in-part of application No. 15/604,727, filed on May 25, 2017, now abandoned.

(51) Int. Cl.
*B26B 5/00* (2006.01)
*B26B 1/10* (2006.01)
*B26B 1/08* (2006.01)

(52) U.S. Cl.
CPC ..... *B26B 5/003* (2013.01); *B26B 1/08* (2013.01); *B26B 1/10* (2013.01)

(58) Field of Classification Search
CPC ..... B26B 11/00; B26B 11/001; B26B 11/003; B26B 11/006; B26B 5/00; B26B 5/003; B26B 5/005; Y10T 403/57; Y10T 403/5706; Y10T 403/5733; Y10T 403/5741
See application file for complete search history.

(56) References Cited

U.S. PATENT DOCUMENTS 495,784 A * 4/1893 Coffin ..... B43K 17/005 401/256
686,424 A * 11/1901 Smith ..... B25B 23/0035 7/165
921,840 A 5/1909 Jacobs
1,672,416 A 6/1928 La Clair
2,517,840 A 8/1950 Chatlos
2,594,955 A * 4/1952 Markowitz ..... B43K 23/001 131/257
4,387,510 A 6/1983 Hashemifard
4,404,874 A * 9/1983 Lieser ..... B25B 15/00 279/102
4,635,309 A * 1/1987 Larsen ..... B25F 1/04 30/162
5,174,028 A * 12/1992 Seltzer, Jr. ..... B25G 1/06 30/329
5,404,616 A 4/1995 Carmien
5,557,818 A * 9/1996 Leon ..... B26B 11/00 30/162

(Continued)

*Primary Examiner* — Andrea L Wellington
*Assistant Examiner* — Richard D Crosby, Jr.
(74) *Attorney, Agent, or Firm* — The Law Offices of Konrad Sherinian LLC

(57) ABSTRACT

An extended cutting knife includes a multifunctional cutting knife and a long handle operatively coupled to the multifunctional cutting knife. The multifunctional cutting knife includes a body, a cover forming a blade housing with the body, a blade disposed within the blade housing and a blade control for releasing the blade from and retracting the blade into the blade housing. The multifunctional cutting knife also includes a receptacle with a threaded outer portion for receiving the extended handle and a polygonal inner portion for receiving a marker. The marker is firmly attached to the body by a marker stopper received by an aperture communicating with the receptacle. The extended cutting knife with the extended handle attached allows a user to cut or mark objects in a standing position and beyond an arm's length. The blade control can include a screw, a knob or a slider.

9 Claims, 5 Drawing Sheets

(56) References Cited

U.S. PATENT DOCUMENTS 5,638,566 A * 6/1997 Wu ..... B25F 1/02 401/18
5,852,840 A 12/1998 Lapp
5,887,306 A * 3/1999 Huang ..... B25B 13/5091 7/165
5,911,761 A 6/1999 Tilley
D412,531 S * 8/1999 Blair ..... D19/117
6,062,753 A * 5/2000 Hadtke ..... B29C 45/1676 401/6
6,138,769 A 10/2000 Breyer
6,142,769 A * 11/2000 Walker ..... B25F 1/04 362/119
6,279,186 B1 * 8/2001 Ge ..... B26B 11/00 7/118
D450,086 S * 11/2001 Rosenbaum ..... D19/123
6,394,677 B2 * 5/2002 Wang ..... B43K 23/02 224/183
6,547,098 B1 * 4/2003 Kaye ..... B26B 5/001 222/191
6,557,730 B1 * 5/2003 Kaye ..... B26B 5/001 222/191
6,766,588 B1 * 7/2004 Hsu ..... G01B 3/1005 242/375
D519,818 S * 5/2006 Knopow ..... D8/99
7,066,673 B1 * 6/2006 Kuo ..... B43K 27/08 401/11
7,203,986 B2 4/2007 Pears
7,237,340 B2 7/2007 Johnson
7,275,323 B2 10/2007 Yang
7,296,316 B1 * 11/2007 Wu ..... B26B 5/00 30/162
8,028,420 B2 10/2011 Gui
8,191,192 B1 * 6/2012 Barker ..... B26B 5/002 7/158
8,636,260 B2 * 1/2014 Gauger ..... A46B 17/08 248/110
D714,386 S * 9/2014 Au ..... D19/204
9,108,454 B1 * 8/2015 Rosenberg ..... B43K 29/00
10,093,028 B2 * 10/2018 Johnson ..... B26B 11/008
2003/0145500 A1 * 8/2003 Lykens ..... G09F 7/04 40/661.01
2004/0031829 A1 * 2/2004 Guimond ..... A45F 5/00 224/196
2004/0163264 A1 * 8/2004 Simonz ..... B23D 49/14 30/517
2005/0138737 A1 * 6/2005 Klein ..... B26B 11/00 7/160
2005/0150116 A1 * 7/2005 Johnson ..... B26B 11/008 30/162
2006/0137191 A1 6/2006 Hightower
2008/0313858 A1 12/2008 Blom
2009/0223064 A1 9/2009 Venderley
2010/0180449 A1 * 7/2010 van Deursen ..... B26B 5/001 30/162
2011/0138540 A1 6/2011 Kinskey
2013/0239415 A1 * 9/2013 Wagner ..... B26B 1/08 30/162
2018/0290315 A1 * 10/2018 Scimone ..... B26B 5/00

* cited by examiner 100
102
104
106
108
110
112
122
124
300
302
312
314

MULTIFUNCTIONAL CUTTING TOOL

CROSS REFERENCE TO RELATED APPLICATIONS

This application is a continuation-in-part of co-pending U.S. patent application Ser. No. 15/604,727, entitled "MULTIFUNCTIONAL CUTTING TOOL," filed May 25, 2017. This application also claims the benefit and priority of the co-pending U.S. patent application Ser. No. 15/604,727, entitled "MULTIFUNCTIONAL CUTTING TOOL," filed May 25, 2017.

FIELD OF THE DISCLOSURE

The present invention generally relates to a cutting knife, and more particularly relates to a cutting knife adapted to be coupled to a long handle. More particularly still, this disclosure relates to a multifunctional cutting knife adapted to be coupled to a long handle and a marker.

DESCRIPTION OF BACKGROUND

Cutting knives have been used by human beings for ages. There are many types of cutting knives designed for different purposes. A cutting knife usually includes a handle and one or more blades. For example, a cutting knife may have a single plate mounted and affixed to a handle. The handle incorporates a notch to receive the rear portion of the blade. Screws or nuts are then used to firmly attached the blade to the handle. As an additional example, the blade of a retractable razor knife is pushed out of a housing disposed within the handle of the knife when it in use. When the user is done with using the retractable cutting knife, the blade is then pulled back into the blade housing for safety reasons.

Retractable cutting knives are used by professionals for cutting variable materials. For instance, professional roofers use retractable cutting knives to cut roof membranes and felt paper; and shipping and delivery professionals use retractable cutting knives to cut cardboards and tapes securing various objects. Retractable cutting knives are also used by people for cutting various materials, such as card boards, at their homes.

Oftentimes, users need to use knives to cut objects beyond reach of their arms. For example, a professional roofer, standing on top of the roof of a residential building, often needs to cut roof membranes or felt paper that he cannot reach by his hands and is not safe to walk to. As an additional example, the professional roofer may need to cut some roof membranes or felt paper that cannot be reached by his hands and requires him to move and reset accessing tools (such as a ladder) for him to perform the cutting. Moreover, the professional roofer may want to be in a standing position when he cuts objects to maintain or improve his health since continuous bending of his knees and back causes harm to his body. When he stands up, roof membranes or felt paper is beyond his arm's length.

Accordingly, there is a need for an improved cutting knife allowing the user to reach an object beyond his arm's length and cut objects while he is in a standing position. Users of cutting knives often use marks, such as a crayon or a pencil, to mark certain objects. For example, a professional roofer uses a crayon to mark a cutting line. He thus needs to carry both a cutting knife and a marker. Therefore, there is a need for a multifunctional cutting knife allowing a user to make both cutting and marking. There is a further need for an improved cutting knife allowing the user to reach an object beyond his arm's length, and perform both cutting and marking.

Objects of the Disclosed System, Method, and Apparatus

Accordingly, it is an object of this disclosure to provide a multifunctional cutting knife with a receptacle for receiving a long handle allowing a user to cut objects beyond his arm's length.

Another object of this disclosure is to provide a multifunctional cutting knife with a threaded receptacle for receiving a long handle allowing a user to cut objects beyond his arm's length.

Another object of this disclosure is to provide an extended cutting knife with a long handle allowing a user to cut objects beyond his arm's length.

Another object of this disclosure is to provide a multifunctional cutting knife with a receptacle for receiving a marking tool allowing a user to both cut and mark objects.

Another object of this disclosure is to provide a multifunctional cutting knife with a special multi-functional receptacle for receiving a marking tool allowing a user to both cut and mark objects.

Another object of this disclosure is to provide a multifunctional cutting knife with a receptacle having a polygonal prism portion for receiving a marking tool allowing a user to both cut and mark objects.

Other advantages of this disclosure will be clear to a person of ordinary skill in the art. It should be understood, however, that a system, an apparatus or a method could practice the disclosure while not achieving all of the enumerated advantages, and that the protected disclosure is defined by the claims.

SUMMARY OF THE DISCLOSURE

Generally speaking, pursuant to the various embodiments, the present disclosure provides an extended cutting knife. The extended cutting knife includes a body having a receptacle, and a cover operatively coupled to the body and forming a blade housing with the body. The extended cutting knife also includes a blade retractably disposed within the blade housing, and a blade control attached to the body for controlling the release and retraction of the blade. Moreover, the extended cutting knife includes an extended handle attached to the body when received by the receptacle.

Further in accordance with the present teachings is a multifunctional cutting knife. The multifunctional cutting knife includes a body having a receptacle that is adapted to receive an extended handle. The multifunctional cutting knife also includes a cover operatively coupled to the body and forming a blade housing with the body. The multifunctional cutting knife further includes a blade retractably disposed within the blade housing, and a blade control attached to the body for controlling release and retraction of the blade. In a further implementation, the multifunctional cutting knife includes a marker stopper and a marker stopper aperture. The mark stopper aperture is adapted to receive the marker stopper, and communicates with the receptacle. The marker stopper is adapted to firmly attach a marker to the body when the marker is inserted into the receptacle.

Further in accordance with the present teachings is a multifunctional cutting knife. The multifunctional cutting knife includes a body having a receptacle at a first end and a blade housing. The receptacle has a cylindrical outer portion and a polygonal inner portion. The cylindrical outer portion is adapted to receive a threaded end of an extended handle for operating the multifunctional cutting knife. The polygonal inner portion is adapted to receive a marker. The multifunctional cutting knife further includes a marker stopper adapted to firmly attach a marker to the body when the marker is inserted into the polygonal inner portion. In addition, the multifunctional cutting knife includes a marker stopper aperture disposed in the body, adapted to receive the marker stopper, and communicating with the polygonal inner portion. Moreover, the multifunctional cutting knife includes a blade locking mechanism adapted to firmly affix a blade to the body. The blade is adapted to be attached to the body and extend away from the body on a second end of the body. The polygonal inner portion can take the shape of a triangular prism, a rectangular prism, a square prism, a pentagonal prism, a hexagonal prism, an octagonal prism, etc. The multifunctional cutting knife can also include a cover operatively coupled to the body. The blade housing is formed between the body and the cover.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figures 1, 2, 3:
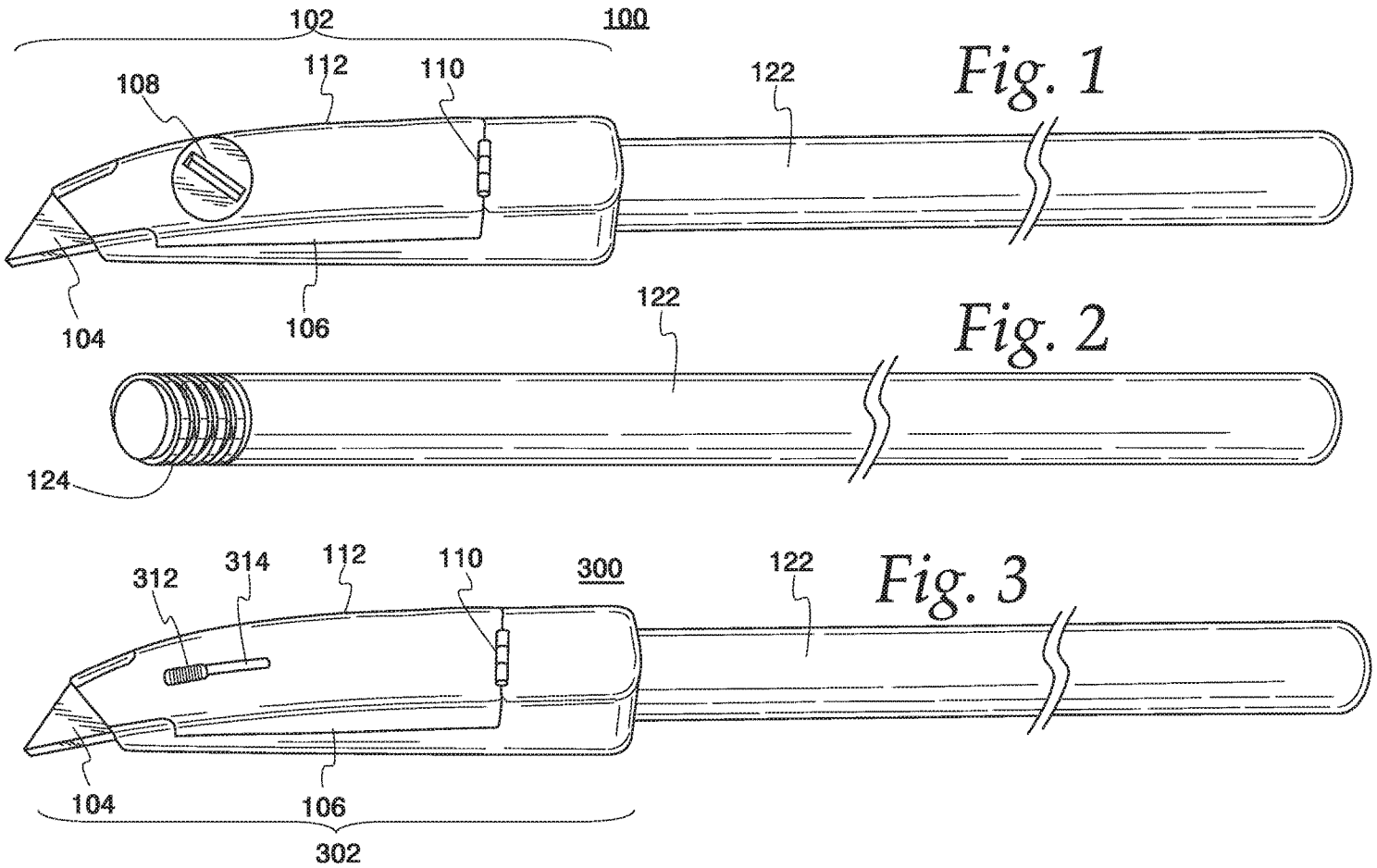
FIG. 1 is a front perspective view of an extended cutting knife with an attached long handle in accordance with this disclosure.
FIG. 2 is a front perspective view of a long handle adapted to be attached to a multifunctional cutting knife in accordance with this disclosure.
FIG. 3 is a front perspective view of a multifunctional cutting knife with an attached long handle in accordance with this disclosure.

Turning to the Figures and to FIG. 1 in particular, a perspective view of an extended cutting knife is shown and generally indicated at 100. The illustrative extended cutting knife 100 includes a multifunctional cutting knife 102 and a long handle 122 (also referred to herein as an extended handle). In one implementation, the multifunctional cutting knife 102 includes a body 112 having a blade housing, a blade 104 disposed within the blade housing in a retracted position, a blade control mechanism 108, a cover 106 and a cover fastener 110. As used herein, the blade control mechanism 108 is said to be attached to the body 112. The blade housing is formed between the cover 106 and the body 112. When the blade 104 is extended outward, it is said to be in a released position and can be used to cut objects. When the blade 104 is retracted into the housing, it is said to be in a retracted position. The release and retraction of the blade 104 is controlled by the blade control 108. In one implementation, the blade control 108 includes a screw with a grove for receiving the tip of a screw driver. A user operates the screw driver to turn the blade control 108 for releasing or retracting the blade 104.

In one implementation, the cover 106 is attached to the body 112 via a hinge 110. A person of ordinary skill in the art will appreciate that alternate attaching mechanisms can be used to couple the cover 106 to the body 112. As used herein, the cover 106 is said to be operatively coupled to the body 112. The multifunctional cutting knife 102 further includes a receptacle for receiving the pole 122. For example, as shown in FIG. 2, the long handle 122 is threaded at an end 124. The threaded end 124 is received by the receptacle when the handle 122 is attached to the knife 102. Alternatively, the handle 122 can be attached to the multifunctional cutting knife 102 using other mounting mechanisms. In a different implementation, the handle 122 is integrally formed with the body 112. In such a case, the handle 122 is also said to be attached to the multifunctional cutting knife 102. In one implementation, the handle 122 is about five feet long. The length of the handle 122 allows a professional roofer to cut felt paper or roof membranes while he is standing on his feet.

Referring to FIG. 3, a front perspective view of an extended cutting knife is shown and generally indicated at 300. The extended cutting knife 300 is an alternate embodiment of the extended cutting knife 100. The extended cutting knife 300 includes a multifunctional cutting knife 302. The multifunctional cutting knife 302 has a blade control mechanism including a slider 312 and a track 314. The slide 312 moves in the track 314 to release or retract the blade 104.

Figure 4:
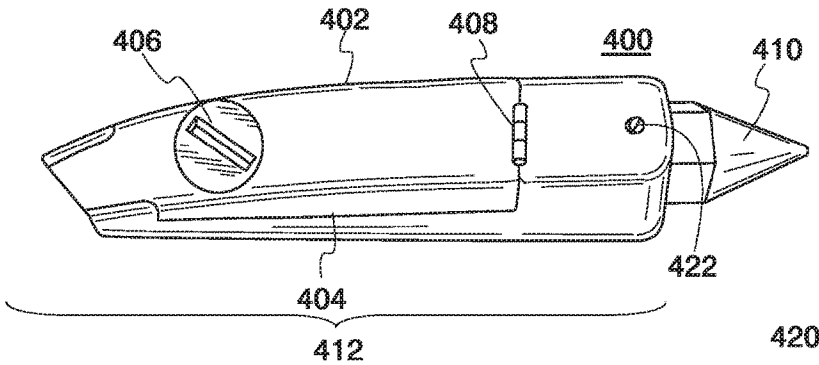
FIG. 4 is a front perspective view of a marking cutting knife with an attached marker in accordance with this disclosure.

Referring to FIG. 4, a front perspective view of a marking cutting knife is shown and generally indicated at 400. The marking cutting knife 400 includes a multifunctional cutting knife 412, which is an alternate embodiment of the multifunctional cutting knife 102. The multifunctional cutting knife 412 includes a body 402, a cover 404, a hinge 408 attaching the cover 404 to the knife body 402. The cover 404 and the knife body 402 form a blade housing between them. A blade, such as the blade 104, is retractably disposed within the blade housing. The multifunctional cutting knife 412 also includes a blade control 406 for controlling the movement of the blade. In the illustrative embodiment, the blade control 406 is a knob that can be operated by a user using his bare hands. The multifunctional cutting knife 412 further includes a receptacle, such as a threaded aperture, for receiving a long handle. For instance, the receptacle receives the threaded end 124.

Figure 5:
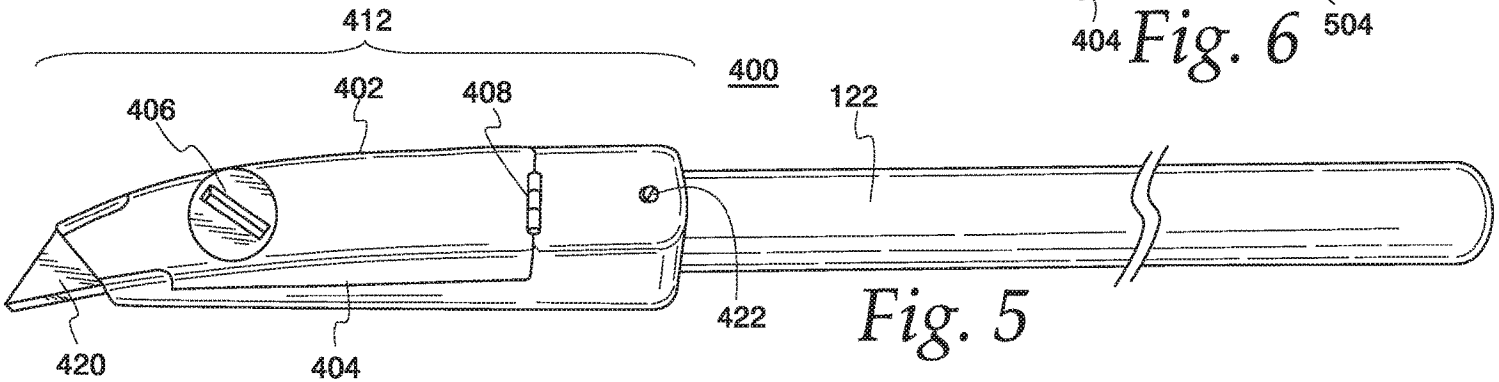
FIG. 5 is a front perspective view of a multifunctional cutting knife with an attached long handle in accordance with this disclosure.

In the illustrative embodiment, the marking cutting knife 400 includes a marker (such as a crayon or a pencil) 410 received by the receptacle. The marker 410 can be attached to the body 402 by friction when inserted into the receptacle. In a further implementation, the body 402 includes an aperture for receiving a marker stopper 422. The marker stopper 422, such as a threaded screw, can be moved inward into the receptacle and thus firmly attach the marker 410 to the body 402. In other words, the marker 410 cannot be removed without excessive force when it is firmly attached to the body 402. The multifunctional cutting knife 412 with a long handle attached is shown in FIG. 5. The blade of the knife 402 is indicated at 420 while the long handle is indicated at 122.

Figure 6:
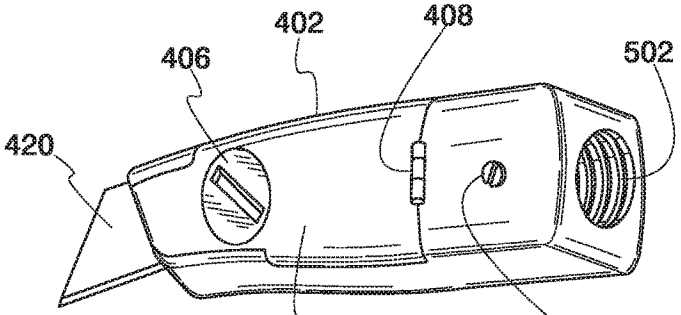
FIG. 6 is a front right perspective view of a cutting knife in accordance with this disclosure.

Referring now to FIG. 6, a front right perspective view of the multifunctional cutting knife 412 is shown. The receptacle for receiving the handle 122 or the marker 410 is indicated at 502. In one implementation, it is a threaded aperture. The aperture for receiving the marker stopper 422 is indicated at 504. The aperture 504 can be a threaded aperture disposed in the body 402 and communicates and connects with the receptacle 502. The receptacle 502 and the aperture, through which the blade 420 extends away from the body 402, are disposed on opposite ends of the body 402.

Figure 7:
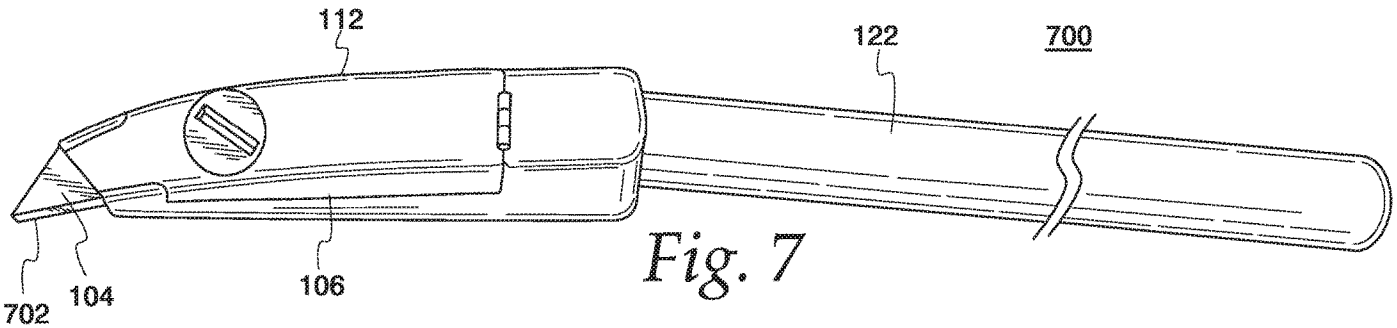
FIG. 7 is a front perspective view of a multifunctional cutting knife with an attached long handle in accordance with this disclosure.

Referring to FIG. 7, a front perspective view of a multifunctional cutting knife is shown and generally indicated at 700. The extended handle 122 is attached to the body 112 such that the cutting edge 702 of the blade 104 is not parallel to the handle 122. Instead, they are arranged at angle. The angle allows a user to apply more cutting force to an object (such as felt paper) being cut. In one embodiment, the cutting edge 702 is a smooth cutting edge without teeth.

Figure 8:
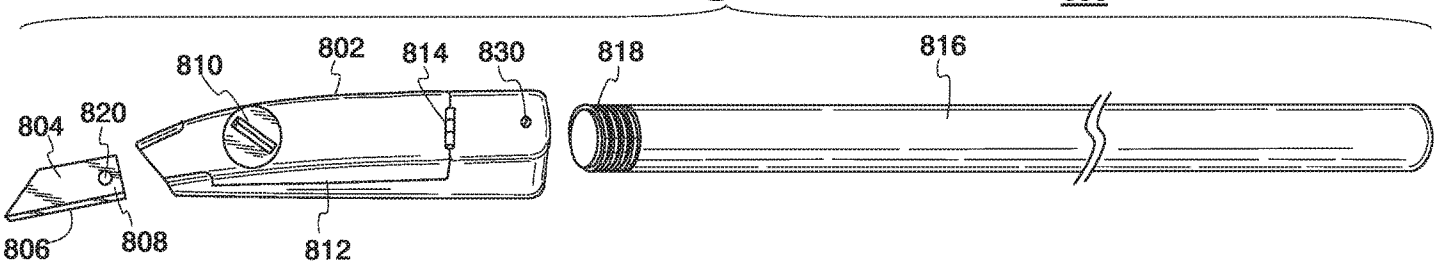
FIG. 8 is an exploded view of a multifunctional cutting knife with an extended handle in accordance with this disclosure.
Figure 9:
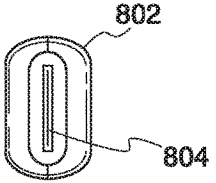
FIG. 9 is a front left side view of a multifunctional cutting knife in accordance with this disclosure.

Referring to FIG. 8, an exploded view of a multifunctional cutting knife is shown and generally indicated at 800. The multifunctional cutting knife 800 includes a body portion 802 and a blade 804. The bladed 804 includes a cutting edge 806 and a rear portion 808. When the blade 804 is attached to the body 802, the rear portion 808 is disposed inside a blade housing. The blade housing is a cavity within the body 802. A side view of the cutting knife 800 with the blade 804 installed is shown in FIG. 9.

In one implementation, the cutting knife 800 incorporates a cover 812 operatively coupled to the body 802 via, for example, a hinge 814. The blade housing is thus a cavity between the body 802 and the cover 812. The cover 812 is firmly closed by a fastener (such as a screw) 810. The closed cover also help keeping the blade 804 in a firmly locked position. In one implementation, the blade 804 incorporates an aperture 820. The aperture 820 receives the fastener 810 in the locked position. In the locked position, the fastener 810 is also received by a cavity (such as a threaded cavity) within the body 802 and an aperture within the cover 812. In such a case, the fastener 810 is a blade locking mechanism. Alternatively, the blade 804 does not incorporate the aperture 820. Instead, the blade 804 to attached to the body 802 using, for example, snapping clips. The cover 812 also assists in keeping the blade 804 in the locked position. In such a case, the snapping clips are a blade locking mechanism. As an additional example, the blade 804 does not incorporate the aperture 820. However, the fastener 810 is operated to move into the body 802 and pushed the bladed 804 against the body 802 for firmly attaching the blade 804 to the body 802. In such a case, the fastener 810 is also said to be a blade locking mechanism.

Figure 10:
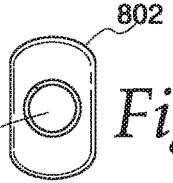
FIG. 10 is a right side view of a multifunctional cutting knife in accordance with this disclosure.

The body 802 also incorporates a receptacle, such as a threaded cavity, for receiving a threaded end of an extended handle 816 or a marker (such as the marker 410. The extended handle 816 allows a user to cut materials using the multifunctional knife 800 while he is in a standing position. The receptacle is indicated at 1002 in FIG. 10. In further implementation, the body 802 incorporates the aperture 504 and includes the marker stopper 422 for firmly attaching the marker 410 to the body 802.

Markers are oftentimes made in the shape of a polygonal prism. In other words, markers have a polygonal base, such as a hexagon, to reduce rolling, increase gripping, save materials, and provide other benefits. Furthermore, it is inevitable that the user will apply some amount force on the markers. Such force can cause markers become loose or damaged inside devices holding the markers. Accordingly, there is a need for an improved tool that provides better grip of markers.

Figure 11:
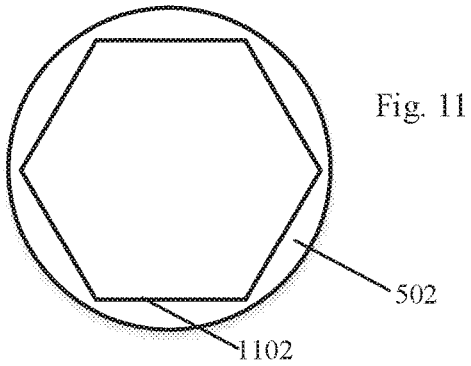
FIG. 11 is a front view of a receptacle of a multifunctional cutting knife in accordance with this disclosure.
Figure 12:
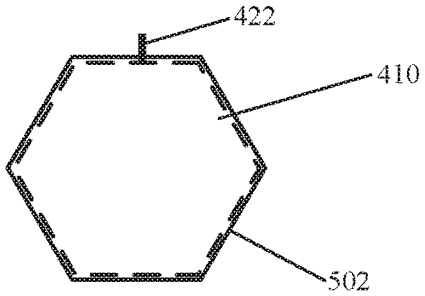
FIG. 12 is a rear view of a receptacle of a multifunctional cutting knife with a marker in accordance with this disclosure.
Figure 13:
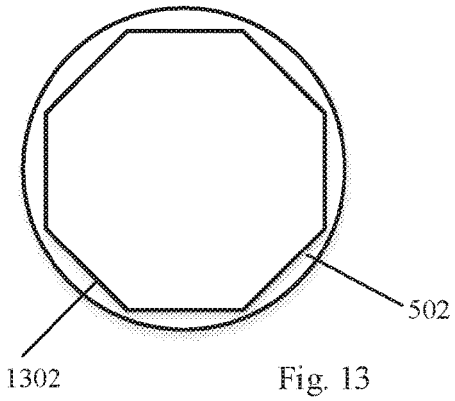
FIG. 13 is a front view of a receptacle of a multifunctional cutting knife in accordance with this disclosure.

An improved knife 402 incorporates an improved receptacle 502 to best fit polygonal markers. The improved receptacle 502 incorporates a polygonal portion as shown in FIGS. 11 through 13. Turning first to FIG. 11, a front view of the improved receptacle 502 is shown. The outer portion of the improved receptacle 502 is adapted to receive the threaded end of a handle (such as the handle 122 and 816). Accordingly, the geometrical shape of the outer portion of the improved receptacle 502 is substantially cylindrical. The inner portion of the improved receptacle 502 takes the shape of a polygonal prism.

In one embodiment, the inner portion is a hexagonal prism and indicated at 1102. When the hexagonal marker 410 is inserted into the receptacle 502, its shape fits the shape of the inner portion of the receptacle 502, and thus prevents rotation of the marker 410 inside the receptacle 502. It should be noted that the marker 410 passes through the cylindrical outer portion first when it is inserted into the receptacle 502. A rear view of the marker 410 and the improved receptacle 502 is shown in FIG. 12. The outline of the marker 410 is indicated using dotted line. The stopper 422 makes contact with the marker 410 to prevent sliding and rotation of the marker 410 within the receptacle 502.

Figure 14:
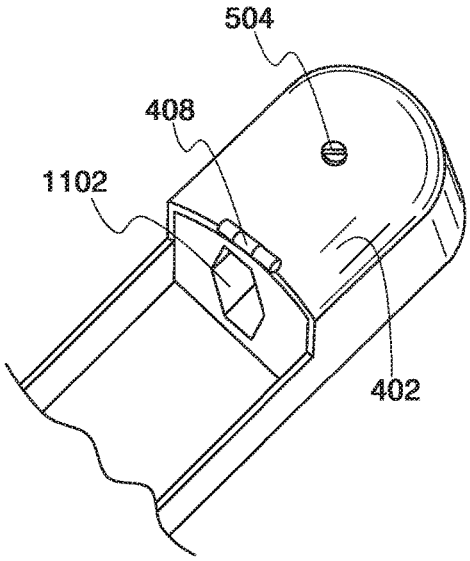
FIG. 14 is a front left perspective view of a cutting knife in accordance with this disclosure.

The polygonal inner portion 1102 is further illustrated in FIG. 14. FIG. 14 is a front left perspective view of the cutting knife without the cover 404 shown.

In accordance with the present teachings, the inner portion of the receptacle 502 can be in other shapes, such as a triangle, a rectangle, a square, or an octagon. FIG. 13 shows a different implementation, where the inner portion of the receptacle is in the shape of an octagonal prism indicated at 1302.

Obviously, many additional modifications and variations of the present disclosure are possible in light of the above teachings. Thus, it is to be understood that, within the scope of the appended claims, the disclosure may be practiced otherwise than is specifically described above. For example, the handle 122 is made of wood or aluminum.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A multifunctional cutting knife, said multifunctional cutting knife comprising:

i. a body having a receptacle at a first end and a blade housing, said receptacle having a cylindrical outer portion and a polygonal inner portion, said cylindrical outer portion adapted to receive a threaded end of an extended handle, said polygonal inner portion adapted to receive a marker;

ii. a marker stopper adapted to firmly attach a marker to said body when said marker is inserted into said polygonal inner portion;

iii. a marker stopper aperture disposed in said body, adapted to receive said marker stopper, and communicating with said polygonal inner portion; and iv. a blade locking mechanism adapted to firmly affix a blade to said body, said blade adapted to be attached to said body and extend away from said body on a second end of said body.

2. The multifunctional cutting knife of claim 1 wherein said polygonal inner portion is in a hexagonal prism shape.

3. The multifunctional cutting knife of claim 1 further comprising a cover operatively coupled to said body, wherein said blade housing is formed between said body and said cover.

4. A multifunctional cutting knife, said cutting knife comprising:

i. a body having a receptacle at a first end and a blade housing, said receptacle having a cylindrical outer portion and a polygonal inner portion, said cylindrical outer portion adapted to receive an extended handle, said polygonal inner portion adapted to receive a marker; and ii. a blade locking mechanism adapted to firmly affix a blade to said body, said blade adapted to be attached to said body and extend away from said body on a second end of said body.

5. The multifunctional cutting knife of claim 4 wherein said cylindrical outer portion is a threaded cavity adapted to receive a threaded end of said extended handle.

6. The multifunctional cutting knife of claim 4 wherein said polygonal inner portion is a polygonal prism.

7. The multifunctional cutting knife of claim 6 wherein said polygonal inner portion is hexagonal prism.

8. The multifunctional cutting knife of claim 4 further comprising a cover operatively coupled to said body, wherein said blade housing is formed between said body and said cover.

9. The multifunctional cutting knife of claim 4 further comprising a marker stopper and a marker stopper aperture, wherein:

i. said mark stopper aperture is adapted to receive said marker stopper;

ii. said mark stopper aperture communicates with said polygonal inner portion; and iii. said marker stopper is adapted to firmly attach a marker to said body when said marker is inserted into said polygonal inner portion.

* * * * *